US005690540A

United States Patent [19]

Elliott et al.

[11] Patent Number: 5,690,540

[45] Date of Patent: Nov. 25, 1997

[54] SPIRAL GROOVED POLISHING PAD FOR CHEMICAL-MECHANICAL PLANARIZATION OF SEMICONDUCTOR WAFERS

[75] Inventors: Richard L. Elliott, Meridian; Michael A. Walker, Boise, both of Id.

[73] Assignee: Micron Technology, Inc., Boise, Id.

[21] Appl. No.: 606,418

[22] Filed: Feb. 23, 1996

[51] Int. Cl.[6] ..... B24B 7/22

[52] U.S. Cl. ..... 451/41; 451/288

[58] Field of Search ..... 451/41, 551, 548, 451/550, 905, 921, 450, 488, 285–291

[56] References Cited

U.S. PATENT DOCUMENTS

| | | | |
|---|---|---|---|
| 2,762,172 | 9/1956 | Franklin | 451/283 |
| 5,131,190 | 7/1992 | Gougougyan | 451/283 |
| 5,177,908 | 1/1993 | Tuttle | 51/283 R |
| 5,216,843 | 6/1993 | Breivogel et al. | 51/131.1 |
| 5,489,233 | 2/1996 | Cook et al. | 451/41 |

FOREIGN PATENT DOCUMENTS

| | | | |
|---|---|---|---|
| 2054666 | 3/1987 | Japan | 451/288 |
| 3086467 | 4/1991 | Japan | 451/288 |

*Primary Examiner*—Robert A. Rose
*Attorney, Agent, or Firm*—Seed and Berry LLP

[57] ABSTRACT

The present invention is a polishing pad for use in chemical-mechanical planarization of semiconductor wafers by placing a wafer against a polishing surface of the polishing pad while rotating the polishing pad about its center in the presence of a polishing slurry. The polishing surface has formed therein one or more grooves extending in a spiral inwardly from the periphery to the center of the polishing pad. As a result, slurry is transported inwardly toward the center or toward the periphery of the polishing pad depending upon the circumferential direction of the spiral relative to the direction of rotation of the polishing pad.

8 Claims, 2 Drawing Sheets

SPIRAL GROOVED POLISHING PAD FOR CHEMICAL-MECHANICAL PLANARIZATION OF SEMICONDUCTOR WAFERS

TECHNICAL FIELD

The present invention relates to chemical-mechanical planarization of semiconductor wafers, and more specifically to an improved configuration for polishing pads that are used for chemical-mechanical planarization of semiconductor wafers.

BACKGROUND OF THE INVENTION

Chemical-mechanical planarization ("CMP") processes are frequently used to planarize the surface layer of a wafer in the production of ultra-high density integrated circuits. In a typical CMP process, a polishing surface on a polishing pad is covered with a slurry solution containing small, abrasive particles and reactive chemicals. A wafer is mounted in a wafer carrier having a planar wafer support surface surrounded by a circular carrier ring. The wafer carrier is positioned opposite the polishing pad with the wafer in contact with the polishing pad. The wafer and/or the polishing pad are then moved relative to one another allowing the abrasive particles in the slurry to mechanically remove the surface of the wafer, and the reactive chemicals in the slurry to chemically remove the surface of the wafer.

CMP processes must consistently and accurately planarize a uniform, planar surface on the wafer at a desired end-point. Many microelectronic devices are typically fabricated on a single wafer by depositing layers of various materials on the wafer, and manipulating the wafer and the other layers of material with photolithographic, etching, and doping processes. In order to manufacture ultra-high density integrated circuits, CMP processes must provide a highly planar surface that is uniform across the entire surface so that the geometries of the component parts of the circuits may be accurately positioned across the full surface of the wafer. Integrated circuits are generally patterned on a wafer by optically or electromagnetically focusing a circuit pattern on the surface of the wafer. If the surface of the wafer is not highly planar, the circuit pattern may not be sufficiently focused in some areas, resulting in defective devices.

FIG. 1 illustrates a conventional chemical-mechanical planarization machine 10 with a platen 20, a wafer carrier 30, and a polishing pad 40. The platen 20 has a top surface 22 upon which the polishing pad 40 is positioned. A drive-assembly 26 rotates the platen 20 as indicated by arrow A, and/or reciprocates the platen 20 back and forth as indicated by arrow B. The motion of the platen 20 is imparted to the polishing pad 40 because the polishing pad 40 is adhered to the top surface 22 of the platen 20.

The wafer carrier 30 has a wafer support surface 32 to which a wafer 34 may be attached such as by drawing a vacuum on the backside of the wafer. A resilient wafer pad 36 may be positioned between the wafer 34 and the support surface 32 to enhance the connection between the wafer 34 and the wafer carrier 30. However, the wafer 34 can be mounted directly on the support surface 32, and it may be secured there by means other than a vacuum. The wafer carrier 30 may have an actuator assembly 38 attached to it for imparting axial and/or rotational motion as indicated by arrows C and D, respectively. The actuator assembly 38 is generally attached to the wafer carrier 30 by a gimbal joint (not shown) that allows the wafer carrier 30 to pivot freely about the three orthogonal axes centered at the end of the actuator 38. In operation, an exposed surface 44 of the wafer 34 is placed in contact with an exposed surface 42 of the polishing pad 40 on which a quantity of slurry 48 is placed.

As mentioned above, it is important to make the surface of the wafer as uniformly planar as possible. Several factors influence the uniformity of the surface of a planarized wafer, three of which are the thickness, flow rate and distribution of the slurry between the polishing pad and the wafer. It is difficult to precisely control the thickness of the layer of slurry between the polishing pad and the wafer because of the many operating variables such as the composition of the slurry, the characteristics of the polishing pad, and the nature and speed of the relative movement between the polishing pad and the wafer. In some cases, it is desirable to have a thinner slurry layer, and in other cases it is desirable to have a substantially thicker layer. Yet has heretofore not been any feasible technique to achieve a desired level of slurry thickness.

It is also difficult to control the flow rate of slurry between the polishing pad and the wafer. The flow rate is an important factor in determining how long a given volume of slurry remains between the polishing pad and the wafer. As explained in greater detail below, under some circumstances it is desirable to quickly remove the slurry from between the polishing pad and the wafer after it has performed only a slight amount of polishing. Under other circumstances, it is desirable for the slurry to remain between the polishing pad and the wafer for a considerable period of time. In the past, it has not been possible to accurately regulate the flow rate of slurry between the polishing pad and the wafer, particularly without affecting other polishing parameters.

Not only is it difficult to control the thickness and flow rate of the slurry between the polishing pad and the wafer, but it is also difficult to ensure that the slurry is uniformly distributed between the polishing pad and the wafer. A uniform distribution of slurry between the polishing pad and the wafer results in a more uniform polishing of the surface on the wafer because the abrasive particles and the chemicals in the slurry will react more evenly across the whole wafer.

There is therefore a need for a polishing pad that facilitates precise control of the thickness, flow rate, and distribution of slurry between the polishing pad and the wafer throughout a range of operating variables such as the composition of the slurry, the characteristics of the polishing pad, and the nature and speed of the relative movement between the polishing pad and the wafer.

SUMMARY OF THE INVENTION

The inventive polishing pad for chemical-mechanical planarization of semiconductor wafers is of the type normally positioned on a moveable platen positioned opposite a wafer carrier. A chemical-mechanical polishing slurry is supplied to the polishing pad so that it can flow between the polishing pad and the wafer. A wafer mounted in the wafer carrier engages a polishing surface of the polishing pad while a drive mechanism rotates the polishing pad and causes relative movement between the platen and the wafer carrier. The polishing surface of the polishing pad has formed therein at least one groove spiraling inwardly toward the center of the polishing pad from a location near the periphery of the polishing pad. As the polishing pad rotates, the groove "pumps" slurry between the polishing pad and the wafer, thereby uniformly distributing the slurry between the polishing pad and the wafer. The direction of the spiral with respect to the direction of rotation of the polishing pad determines whether the slurry is pumped in toward the center of the polishing pad or out toward the periphery of the polishing pad. In the event that the groove pumps slurry away from the center of the polishing pad, the groove preferably extends all the way to the periphery of the polishing pad. In the event that the groove pumps slurry away from the periphery, the groove preferably extends all the way to the center of the polishing pad. The number of grooves formed in the polishing surface of the polishing pad as well as the width, thickness, and pitch (i.e., distance between grooves) of the grooves controls the rate at which the polishing pad pumps slurry between the polishing pad and the wafer. The rate and direction of pumping affects the both the thickness as well as the residence time of the slurry between the polishing pad and the wafer.

DETAILED DESCRIPTION OF THE INVENTION

Figure 2:
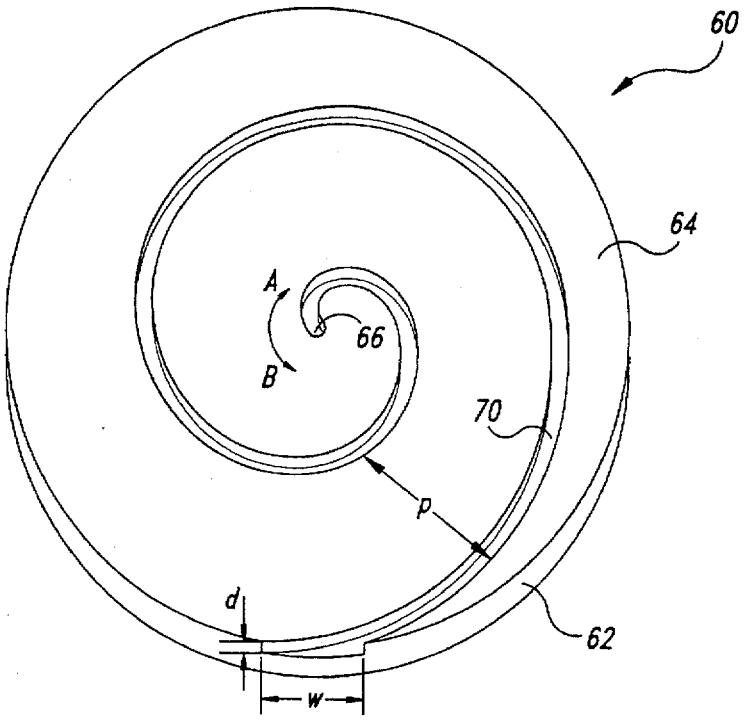
FIG. 2 is an isometric view of a preferred embodiment of the inventive polishing pad.

A preferred embodiment of the inventive polishing pad 60 is illustrated in FIG. 2. The polishing pad 60 has a generally cylindrical configuration with a periphery bounded by a sidewall 62, and a generally planar polishing surface 64 of circular configuration having a center 66. The configuration and composition of the polishing pad 60 as explained above is conventional and is thus not explained for purposes of brevity. The inventive polishing pad 60 differs from conventional polishing pads in that the polishing pad 60 has a groove 70 formed in the polishing surface 64 that extends inwardly in a spiral from the sidewall 62 to the center 66 of the polishing pad 60. The groove 70 has a depth D, a width W, and a pitch P (i.e., the distance between corresponding edges of the groove 70), all of which will affect the operation of the polishing pad 60, as explained below.

The purpose of the groove 70 is to transport slurry (not shown in FIG. 2) either inwardly toward the center 66 of the polishing pad 60 or outwardly toward the periphery of the polishing pad 60, depending upon the direction that the polishing pad 60 is rotated. More specifically, if the polishing pad is rotated in the direction of the arrow A, slurry will be forced into the groove 70 from the periphery of the polishing pad 60 so that slurry will be pumped inwardly toward the center 66 of the polishing pad 60. Conversely, if the polishing pad 60 is rotated in the direction of the arrow B, slurry will be drawn from the groove 70 at its periphery so that the polishing pad 60 will pump slurry outwardly from the center 66 of the polishing pad 60. Whether it is desired for the polishing pad 60 to pump slurry inwardly or outwardly depends upon a wide variety of operational parameters in the planarization process. Basically, pumping slurry inwardly causes the slurry to be relatively thick between the polishing surface 64 of the polishing pad 60 and a wafer (not shown) and it causes the slurry to remain there for a relatively longer period of time. It may be desirable to pump the slurry outwardly if the indenter, i.e., the particles within the slurry, tend to break down with relative ease, thus making it desirable to remove broken down indenters from between the polishing surface 64 in the wafer. However, under other circumstances it might be desirable to maintain slurry having easily broken down indenters between the polishing surface 64 and the wafer for a considerable period so that the polishing rate of the wafer is gradually reduced. If the slurry is of the type in which the indenter does not break down but instead agglomerates to a larger size, it will generally be desirable to keep the slurry between the polishing surface 64 and the wafer as long as possible. Under these circumstances, the polishing pad 60 will be rotated so that slurry is pumped inwardly toward the center 66. An example of a slurry having indenters that easily break down is cerium oxide. An example of a slurry having an indenter that does not break down easily is a diamond indenter. It will also be desirable to control the residence time of the slurry between the polishing surface 64 and the wafer for other reasons. For example, if the pH of the slurry changes with use, it may be desirable to ensure that the slurry is removed from between the polishing surface 64 and the wafer. Under these circumstances, it will generally be desirable to pump slurry outwardly toward the periphery of the polishing pad 60.

The rate at which slurry is pumped will be affected by not only the physical configuration of the groove 70, but also the rotational velocity of the polishing pad 60. Generally, grooves 70 having a larger depth D or a larger width W will pump slurry at a faster rate. Reducing the pitch P of the groove 70 causes a greater volume of slurry to be carried by the polishing surface 64, although the slurry is transported radially inwardly or outwardly at a slower rate. Thus, optimizing the specific configuration of the groove 70 will depend upon experimental results of actual use of the polishing pad 60.

Figure 3:
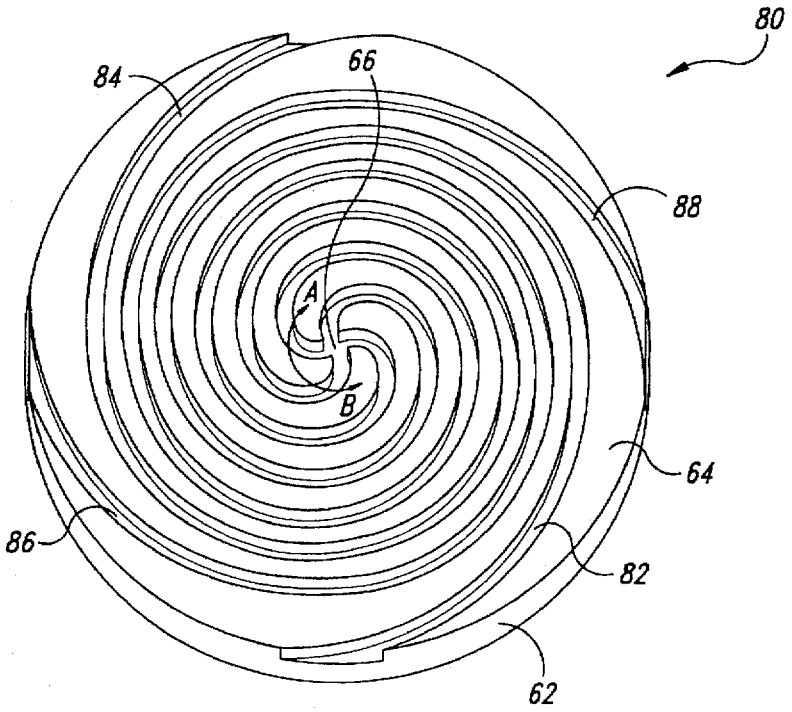
FIG. 3 is an isometric view of an alternative embodiment of the inventive polishing pad.

An alternative embodiment of a polishing pad 80 is shown in FIG. 3. The polishing pad 80 uses four grooves, 82, 84, 86, 88 that are interleaved with each other as they extend from the sidewall 62 to the center 66 of the polishing pad 80. Although the polishing pad 80 shown in FIG. 4 utilizes only four grooves, 82–88, it will be understood that a larger number of grooves may be used. Generally, increasing the number of grooves increases the volume of slurry between the polishing surface 64 of the polishing pad 80 and the wafer as well as the rate at which slurry is transported radially inwardly or outwardly along the polishing surface 64.

Figure 1:
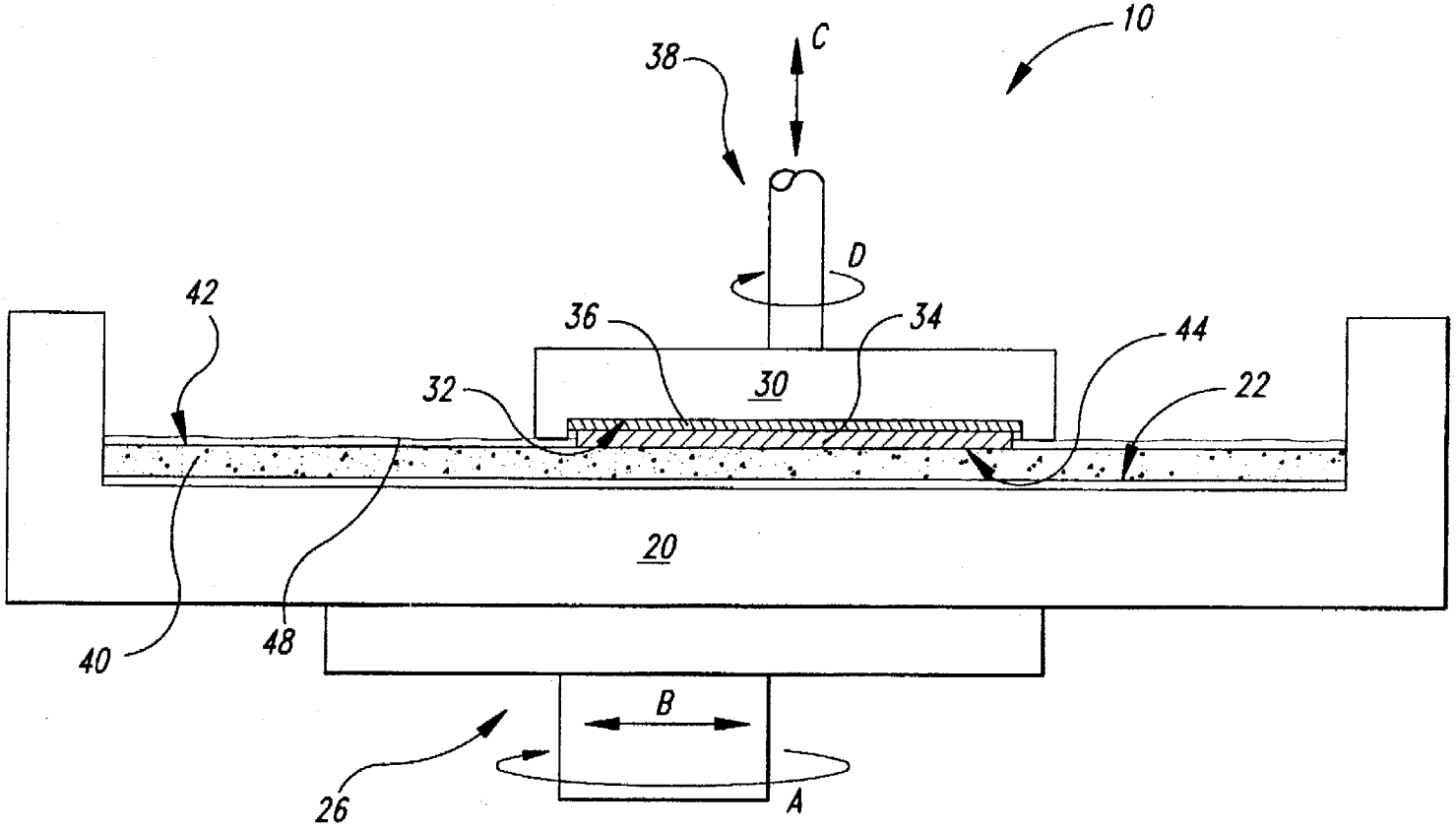
Fig. 1 (Prior Art)
FIG. 1 is a schematic cross-sectional view of a prior art chemical-mechanical planarization machine.

The inventive polishing pad 60, 80 can be used as a substitute for the polishing pad 40 shown in FIG. 1 to polish semiconductor wafers mounted in a wafer carrier 30.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A machine for planarization of a semiconductor wafer, comprising:

a movable platen;

a polishing pad positioned on the moveable platen, the polishing pad including a polishing surface having formed therein at least one groove extending inwardly in a spiral from a location adjacent the periphery of said polishing pad toward the center of said polishing pad;

a wafer carrier positioned opposite the polishing pad so that a wafer in said wafer carrier can engage said polishing pad, said wafer carrier including a circular, planar support surface with a diameter that is at least as large as the diameter of said wafer for supporting said wafer on said support surface;

a supply of slurry on said polishing pad; and a drive mechanism for rotating said polishing pad about its center in a direction opposite the circumferential direction of said groove as it extends inwardly from the periphery toward the center of said pad, said rotation causing relative movement between said platen and said wafer carrier so that said wafer slides along said polishing pad during chemical-mechanical planarization of said wafer and causing said groove to pump said slurry through said groove inwardly toward the center of said polishing pad.

2. The chemical-mechanical planarization machine of claim 1 wherein each groove formed in the polishing surface of said polishing pad extends to and is open at the periphery of said polishing pad.

3. The chemical-mechanical planarization machine of claim 1 wherein each groove formed in the polishing surface of said polishing pad extends to the center of said polishing pad.

4. The chemical-mechanical planarization machine of claim 1 wherein each groove formed in the polishing surface of said polishing pad extends at least one revolution around the center of said polishing pad.

5. A method of planarizing a semiconductor wafer, comprising:

providing a polishing pad having a polishing surface with at least one groove formed therein, each groove formed in the polishing surface of said polishing pad extending inwardly in a spiral from a location adjacent the periphery of said polishing pad toward the center of said polishing pad;

placing said wafer in contact with the polishing surface of said polishing pad;

placing slurry on said polishing pad; and rotating said polishing pad about its center in a direction opposite the circumferential direction of said groove as it extends inwardly toward the center of said pad so that said wafer slides along said polishing pad during chemical-mechanical planarization of said wafer and said groove pumps said slurry through said groove inwardly toward the center of said polishing pad.

6. The method of claim 5 wherein each groove formed in the polishing surface of said polishing pad extends to and is open at the periphery of said polishing pad.

7. The method of claim 5 wherein each groove formed in the polishing surface of said polishing pad extends to the center of said polishing pad.

8. The method of claim 5 wherein each groove formed in the polishing surface of said polishing pad extends at least one revolution around the center of said polishing pad.

* * * * *